US010612728B2

(12) United States Patent
Soni

(10) Patent No.: US 10,612,728 B2
(45) Date of Patent: Apr. 7, 2020

(54) LED LIGHT BULB ASSEMBLY AND METHOD FOR MANUFACTURING SAME

(71) Applicant: CORVI LED PVT LTD, Mumbai (IN)

(72) Inventor: Vimal Soni, Mumbai (IN)

(73) Assignee: CORVI LED PVT LIMITED, Mumbai (IN)

( * ) Notice: Subject to any disclaimer, the term of this patent is extended or adjusted under 35 U.S.C. 154(b) by 0 days.

(21) Appl. No.: 15/572,700

(22) PCT Filed: Jun. 3, 2016

(86) PCT No.: PCT/IN2016/050166
§ 371 (c)(1),
(2) Date: Nov. 8, 2017

(87) PCT Pub. No.: WO2016/194005
PCT Pub. Date: Dec. 8, 2016

(65) Prior Publication Data

US 2018/0135811 A1 May 17, 2018

(30) Foreign Application Priority Data

Jun. 4, 2015 (IN) ..... 2157/MUM/2015
Jul. 17, 2015 (CH) ..... 1045/15

(51) Int. Cl.

| | |
|---|---|
| ***F21V 1/00*** | (2006.01) |
| ***F21K 9/238*** | (2016.01) |
| ***F21V 19/00*** | (2006.01) |
| ***F21K 9/232*** | (2016.01) |
| ***F21K 9/235*** | (2016.01) |
| ***F21K 9/90*** | (2016.01) |
| ***F21V 23/06*** | (2006.01) |
| *F21Y 115/10* | (2016.01) |

(Continued)

(52) U.S. Cl.
CPC ..... *F21K 9/238* (2016.08); *F21K 9/232* (2016.08); *F21K 9/235* (2016.08); *F21K 9/90* (2013.01); *F21V 19/003* (2013.01); *F21V 19/0015* (2013.01); *F21V 23/06* (2013.01); *F21V 3/00* (2013.01); *F21V 3/02* (2013.01); *F21Y 2107/40* (2016.08); *F21Y 2115/10* (2016.08)

(58) Field of Classification Search
CPC . F21K 9/237; F21K 9/235; F21K 9/23; F21V 19/0015; F21V 19/003; F21V 23/06
USPC ..... 362/235
See application file for complete search history.

(56) References Cited

U.S. PATENT DOCUMENTS

2013/0271981 A1* 10/2013 Hussell ..... F21V 7/00 362/235
2015/0117018 A1* 4/2015 Chen ..... F21V 17/101 362/294

* cited by examiner

*Primary Examiner* — Matthew J. Peerce
(74) *Attorney, Agent, or Firm* — Egbert, McDaniel & Swartz, PLLC

(57) ABSTRACT

An LED light bulb assembly having a base provided with a connection portion for connecting the assembly to an electric light bulb socket, and with a holding portion, the connection portion and the holding portion facing in opposite directions running essentially in parallel to a central axis of the assembly. The assembly has a substrate carrying at least one LED and having a mounting section which is affixed to the holding portion in a fully assembled state of the assembly. A method for assembling an LED light bulb assembly as described above is also disclosed. The LED light bulb assembly is easy to assemble, yet rugged, and allows for fully automating the production or at least minimizing manufacturing efforts, and thus reducing the costs of LED light bulbs.

10 Claims, 11 Drawing Sheets

(51) Int. Cl.

| | |
|---|---|
| *F21V 3/00* | (2015.01) |
| *F21Y 107/40* | (2016.01) |
| *F21V 3/02* | (2006.01) |

LED LIGHT BULB ASSEMBLY AND METHOD FOR MANUFACTURING SAME

FIELD OF THE INVENTION

The present invention relates to a light emitting diode (LED) light bulb assembly. Further, the present invention relates to a method for manufacturing a LED light bulb assembly.

BACKGROUND OF THE INVENTION

The use of LEDs for a lighting application is currently increasing. Especially in light bulbs for standardized sockets, such as the E22 or E26 sockets, previously used light sources like filaments, fluorescent tubes and other luminescent materials are subsequently replaced by LEDs. Thereby, the energy consumption of the light bulbs may be reduced.

In LED light bulbs according to the prior art, the LEDs are commonly embedded on a substrate, which may be a printed circuit board (PCB) for example. The LEDs may be soldered or otherwise mounted to the PCB. One or more PCBs are mounted to a base of the light bulb with the help of fixation means such as screws or rivets. The base is provided with means for mechanically connecting the light bulbs to a socket as well as to establish an electrical contacts with respective contacts of the socket for providing electrical energy to the light bulb and thus the at least one LED thereof. Such light bulbs according to the prior art are e.g. known from documents U.S. Pat. Nos. 8,894,268 B2, 8,704,432 B2, US 2014/005600181, US 2014/98303 A1, and EP 2 5 277 308 A1.

LED light bulbs according to the prior art are disadvantageous in that their assembly and in particular mounting the PCB to the base is cumbersome especially because of the fixation means used therefore. Furthermore, the number of parts involved in the light bulbs according to the prior art is fairly high. Due to the complicated assembly and the high number of parts, fully automating the production of LED light bulbs according to the prior art can hardly be achieved. Hence, there are still manual steps involved in the production. Consequently, manufacturing LED light bulbs according to the prior art is inefficient and bears extensive costs which again leads to relatively high prices of the known LED light bulbs.

SUMMARY OF THE INVENTION

In view of the disadvantages of known LED light bulbs described above, an object underlying the present invention is to provide an LED light bulb assembly, which is easy to assemble, yet rugged, and allows for fully automating the production or at least minimizing manufacturing efforts, and thus reducing the costs of LED light bulbs.

According to the present invention, these objects are achieved through the features of the independent claims. In addition, further advantageous embodiments follow from the dependent claims and the description.

According to the present invention, the above-mentioned objects are particularly achieved with a LED light bulb assembly in that the assembly comprises a base provided with a connection portion, for connecting the assembly to an electric light bulb socket, and with a holding portion, the connection portion and the holding portion facing in opposite directions running essentially in parallel to a central axis of the assembly; and a substrate carrying at least one LED and having a mounting section which is affixed to the holding portion in a fully assembled state of the assembly, wherein the holding portion and the mounting section in the fully assembled state abut each other in a plane extending essentially in parallel to the central axis.

For a method mentioned in the beginning of the description, the above-mentioned objects are achieved in that a base is being provided with a connection portion, for connecting the assembly to an electric light bulb socket, and with a holding portion, the connection portion and the holding portion facing in opposite directions running essentially in parallel to a central axis of the assembly; and wherein a substrate for carrying at least one LED is being provided with a mounting section for fixing the substrate to the holding portion in a fully assembled state of the assembly, and wherein the holding portion and the mounting section are brought into abutment with each other in the fully assembled state in a plane extending essentially parallel to the central axis.

These solutions allow that the substrate and the base may be simply plugged together in that they are moved towards each other essentially in parallel to the central axis. The holding portion and the mounting section may be joined by a single sliding movement of the substrate with respect to the base. Hence, additional fixation means for fixing the substrate to the base may be omitted especially when the substrate, in particular the mounting section thereof, is oriented perpendicularly to the central axis. The mounting section and the holding portion may become wedged when brought into engagement with each other such that friction fit and/or force fit between the substrate and the base is established.

In other words, the substrate may be affixed to the base by moving the substrate towards the base in an insertion direction of the assembly. The mounting section of the substrate and the holding portion of the base may be formed and arranged such that the substrate is directly fixed to the base in a force fit and/or friction fit manner A connection portion for connecting the assembly to a desired standardized electric light bulb socket or fitting and extending along the insertion direction for at least partially inserting the connection portion into the socket or fitting may be provided at the base.

In the following paragraphs, further improvements of the assembly and the method according to the present invention are described. The additional improvements may be combined independently of each other, depending on whether a particular advantage of a particular improvement is needed in a specific case.

According to a first advantageous improvement of the assembly, in the fully assembled state, the substrate may at least partially protrude into the holding portion. In particular, the mounting section may protrude into the holding portion and/or connection portion in the insertion direction. Thereby, the mounting section and the holding portion may be easily brought to abutment with each other in a plane extending essentially parallel to the central axis. At the same time, overall dimensions of the assembly, especially measured in parallel to the central axis or a height direction of the assembly, may be minimized.

In the fully assembled state, the substrate and the connection portion may superimpose each other in a radial direction of the assembly, the radial direction extending essentially perpendicularly away from the central axis. The holding portion may at least partially overlap with the connection portion in a projection along the radial direction. In other words, the mounting section may be slid beyond an end region of the holding section pointing in a direction running opposite to the insertion direction. This facilitates to bring the mounting section into engagement with the holding portion and establish a force fit and/or friction fit between them.

In the fully assembled state, the holding portion may be at least partially arranged in a cavity formed within an extension of the base. Alternatively and/or additionally, an outer perimeter of said extension may at least form a part of the connection portion. Thereby, the overall dimensions of the assembly, especially in the height direction, may be reduced. Further, it is facilitated to establish an electrical contact between the substrate, in particular the mounting section thereof, and the connection portion since the distance therebetween is reduced in comparison to assemblies known from the prior art.

The mounting section may be at least partially in a positive engagement with the holding portion. By establishing a force fit, friction fit and/or positive fit between the mounting section and the holding portion, the substrate may be reliably fixed to the base. The positive fit especially helps in avoiding unwanted rotational movements of the substrate with respect to the base around the central axis. In order to a enable a proper fit between the mounting section and the holding portion, the substrate may be provided with a slot extending along the height direction and opening in the insertion direction such that a keying or coding means may enter the slot while joining the substrate with the base.

At least a cross-section of the mounting section may have a polygonal shape in a projection along the central axis and/or the insertion direction. A polygonal shape may help to establish a positive fit between the substrate and the base. For example, the cross-section may have a hexagonal shape. In any case, the substrate, in particular the mounting section thereof may have a tubular shape. An illuminating section of the substrate being arranged above the mounting section may also have a tubular shape and may provide several side faces for carrying LEDs. The illuminating section may merge with the mounting section such that they are aligned with each other in a projection along the insertion direction and/or height direction. Additionally, the substrate may be provided with a flat top or cap providing another surface for carrying at least one LED. Each of the sides and the top of the substrate may be carrying at least one LED.

At least one contact surface for electrically connecting the substrate to the connection portion may be formed at the mounting section. In the fully assembled state, the at least one contact surface may extend along a plane running essentially in parallel to the central axis. The at least one contact surface may be provided at the mounting section of the substrate. Thereby, when bringing the mounting section into abutment with the holding portion for mounting the substrate to the base, at the same time an electrical contact to the substrate may be established by contacting the at least one contacting surface.

At least one mounting surface for holding the substrate and the at least one contacting surface may be formed at the mounting section in such a way that they are arranged next to each other along an outer perimeter and/or an inner perimeter of the substrate. Thereby, it may be provided that a plurality of mounting surfaces and a plurality of contacting surfaces are formed at the mounting section in such a way that they may be simultaneously brought into abutment with the holding portion when bringing the substrate into engagement with the base.

A plurality of contact surfaces and mounting surfaces may be arranged along the outer perimeter and/or inner perimeter in an alternating manner Thereby, at least one holding surface may be arranged between two contact surfaces having different predefined electric polarizations. This helps in prevention of mismating the substrate with the base. The substrate, in particular the mounting section thereof may be shaped in such a way that it may only be mated with the base in a predefined orientation with relation to the holding portion. Such an orientation may be defined for example by slot or other coding means which help in preventing to mismate the substrate and the base.

The assembly may further comprise at least one first contact element which in the fully assembled state is at least partially arranged between the mounting section and the holding portion so that it establishes an electrical contact with the substrate. The contact element may be formed e.g. of an electrically conductive polymer and/or an electrically conductive metal or metal alloy. A polymer, however, has the advantage over metals, that it may be more cost efficient in terms of production technology and resources. The contact element may abut the holding surface and/or the contacting surface in order to help immobilizing the substrate with respect to the base.

The at least one first contact element may comprise a fitting portion which is shaped complementary to the mounting section and/or holding portion. Thereby, at least two of the substrate, the base, and at least one first contact element may be formed complementarily to each other. In the fully assembled state, the substrate, in particular the mounting section thereof, the base, in particular the holding section thereof and the at least one first contact element, in particular the fitting portion thereof, may be in positive engagement with each other. The fitting portion may be snugly fitted between the mounting section and the holding portion. In other words, the fitting portion may be sandwiched between the mounting section and the holding portion so that a compact arrangement of the substrate, the base and the contact element is achieved.

A first electrical contact of the assembly which in the fully assembled state is accessible from outside of the assembly at the connection portion may be formed at the at least one first contact element. The first electrical contact may be a so-called hot contact. The at least one first contact element may comprise a conductor portion which may connect the fitting portion to the electrical contact in an electrically conductive manner. The fitting portion, the conductive portion and/or the contact element may be integrally formed at the at least one first contact element. The at least one first contact element may be formed and/or comprised of only one material, such as a conductive polymer already mentioned above.

The assembly may further comprise at least one second contact element which in the fully assembled state may be at least partially arranged between the mounting section and the holding portion so that it establishes an electrical contact with the substrate. Thereby, a second electrical contact, e.g. a ground or cold contact may be provided for electrically connecting the assembly to a socket. The at least one second contact element may be formed and arranged similarly to the at least one first contact element. The at least one first and/or a second contact elements may be provided with threads or alike as desired in order to connect the assembly to a socket, e.g. by screwing the assembly into the socket in a known manner for affixing the assembly and at the same time establishing an electrical contact between the assembly and respective electrical counter contacts within the socket.

The assembly may further comprise at least one translucent dome which in the fully assembled state may be attached to the base so that it may house-in the substrate. The dome and the base may be brought into positive engagement with each other. The dome may be provided with a fixation structure which may comprise collars, limit stops, walls and/or lateral supports or alike in order to limit and/or inhibit movements of the substrate with respect to the base.

For the method mentioned in the beginning of the description, the inventive solution may be further improved according to the features mentioned above with respect to the assembly. A person skilled in the art will have no difficulty in understanding that the implementation of every device or apparatus feature mentioned in connection with the assembly above may be interpreted as at least one advantageous method step which may be chosen as desired for facilitating the manufacturing of the assembly and/or providing an assembly with the desired technical specifications.

For example, the substrate may be fixed to the holding portion along the insertion direction in which the connection portion is supposed to be inserted into a socket. The mounting section of the substrate may be provided with a holding surface which may be arranged essentially in parallel to the insertion direction. The mounting section may be brought into engagement with the base of the assembly by moving the substrate towards the base in the insertion direction, whereby the substrate, the base and/or at least one contact element of the assembly may become wedged with respect to each other and/or maybe brought into positive engagement with each other. Thereby, at the same time, the substrate may be affixed to the base and an electrical contact may be established between the base and the substrate.

BRIEF DESCRIPTION OF THE DRAWINGS

In the following paragraphs, the invention and its improvements are described in greater detail by using exemplary embodiments thereof and with reference to the accompanying drawings. As described above, the various features shown in the embodiments may be used independently of each other according to the respective requirements of specific applications or may be omitted. The present invention will be explained in more detail, by way of example, with reference to the drawings in which.

DETAILED DESCRIPTION OF THE PREFERRED EMBODIMENTS

Figure 1:
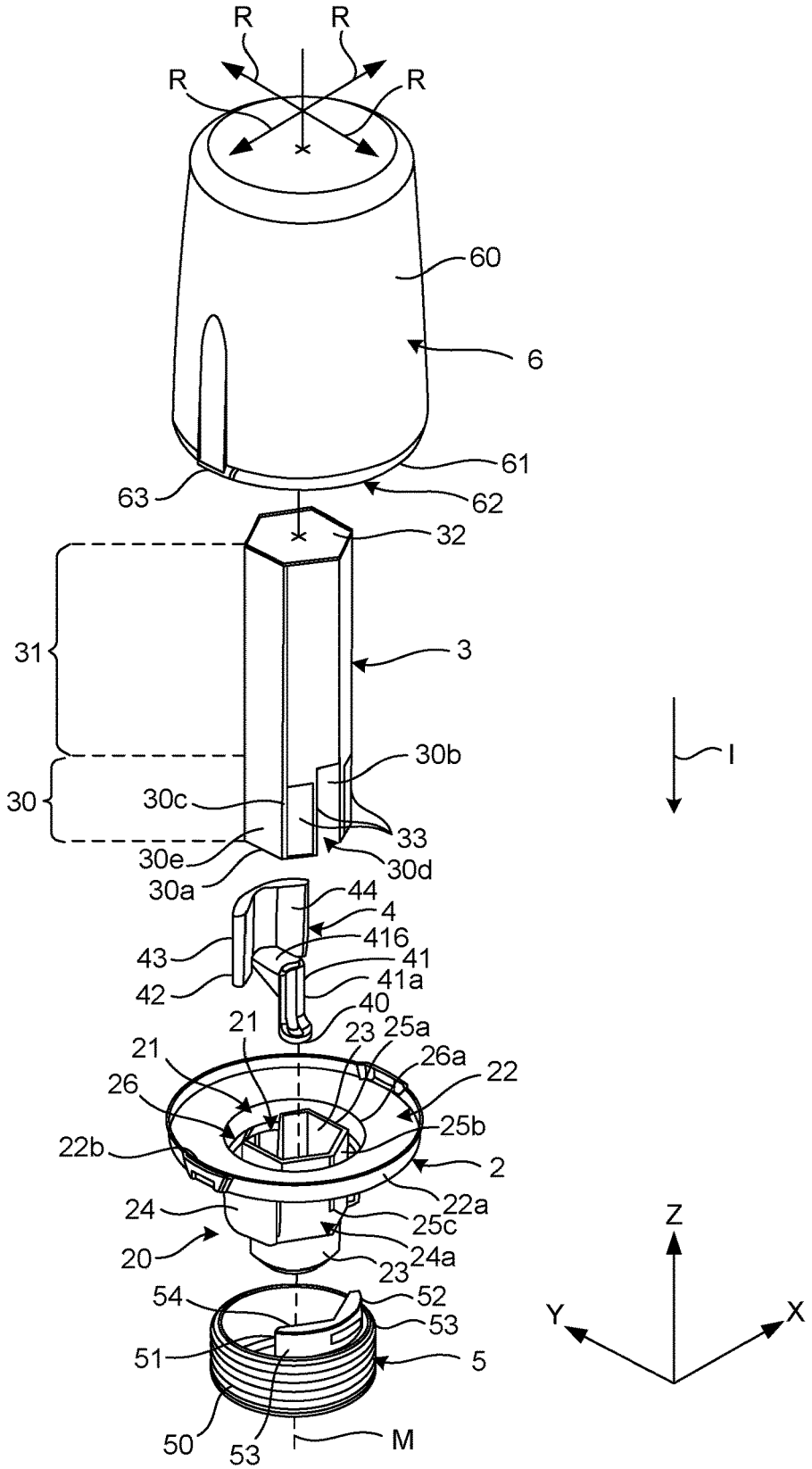
FIG. 1 is a schematic perspective exploded view of a first embodiment of a LED light bulb assembly according to the present invention.

FIG. 1 shows a first embodiment of a LED light bulb assembly 1 according to the present invention in a schematic perspective exploded view. The assembly 1 extends along a lateral direction X, a transverse direction Y and a height direction Z which together form a Cartesian coordinate system, i.e. the lateral direction X extends perpendicularly to the transverse direction Y as well as to the height direction Z which extends perpendicularly to the transverse direction Y. In FIG. 1, the assembly 1 is shown in an unassembled state U where all its elements may be separated from each other and ready to be assembled.

The assembly 1 comprises a base 2, a substrate 3, a first contact element 4, a second contact element 5, and a translucent dome 6 which are distanced from each other in the height direction Z. A central axis or middle axis M of the assembly 1 extends essentially in parallel to the height direction Z. An insertion direction I of the assembly 1 extends essentially in parallel to the central axis M and maybe superimposed therewith. In the insertion direction I, the assembly 1 may be inserted into a light bulb socket (not shown). Further, in the insertion direction I, the substrate 3, the first contact element 4 and the dome 6 maybe mated with the base 2, while the second contact element 5 maybe mated with the base 2 in a direction extending opposite to the insertion direction I.

The Base 2 is provided with a connection portion 20, configured to connect the assembly 1 to an electric light bulb socket which may be e.g. a standardised E26 socket, and with a holding portion 21, for holding the substrate 3. The base further comprises a flange 22 circumferentially surrounding the holding portion 21 and adapted for holding the dome 6. The connection portion 20 is protruding from the flange 22 in the insertion direction I and comprises a stud 23 which is partially circumferentially surrounded by a collar 24. Through an opening 24*a* of the collar, the holding portion 21 is accessible from below the flange 22 so that the second contact element 5 may protrude from outside of the assembly 1 into the assembly 1 through the base 2 in a fully assembled state W of the assembly 1 (see FIGS. 2 to 12). The flange 22 may have a rim 22*a*. At least one latching element 22*b* may be formed at the flange 22 and in particular at the rim 22*a* in order to latch the dome 6 to the base 2 the fully assembled state W.

The holding portion 21 comprises a holder 25 for holding the substrate 3. The holder 25 is arranged within a cavity 26 and maybe designed such that an upper edge 25*a* of the holder 25 may be essentially aligned with an edge 26*a* of the cavity 26 in a plane extending along the lateral direction X and transverse direction Y, i.e. that they are essentially arranged at the same height. The holder 25 may have a tubular shape and maybe arranged coaxially with the cavity 26 which may have a shape, e.g. with a circular cross-section. The holder 25 may be provided with a plurality of holding surfaces 25*b* which may be separated from each other by corners 25*c*. The holding surfaces 25*b* and corners 25*c* may have regular and/or equal lengths and angles, respectively, so that the holder 25 has a polygonal cross-section in a projection along the insertion direction I. The holder 25 maybe further provided with a cut-out 25*d* opening in the insertion direction I and allowing for accommodating the first contact element 4 within the cavity 26.

The substrate 3 may be e.g. a printed circuit board (PCB) which may have a tubular shape. The substrate 3 has a mounting section 30 and an illuminating section 31. At the top of the substrate 3, in particular of the illuminating section 31, a cap 32 maybe arranged. The illuminating section 31, e.g. the outer perimeter thereof, and/or the cap 32 may be carrying at least one LED. The mounting section 30 may have a lower edge 30*a* and a plurality of inner mounting surfaces 30*b* which may be separated from each other by corners 30*c* in the same or a similar manner as the holding surfaces 25*b* of the holder 25. The mounting surfaces 30*b* maybe evenly distributed along and inner perimeter of the substrate 3, in particular of the mounting section 30. A notch or slot 30*d* maybe formed in the substrate 3, particular in the mounting section 30. The slot 30 may extend from the lower edge 30*a* upwardly e.g. in a wall portion of the substrate 3, so that a correct orientation of the substrate 3 with respect to the base 2 is defined. In other words, the slot 30*d* may help in coding the orientation of the substrate 3 with respect to the base 2, so that mismating the substrate 3 with the base 2 is prevented. In addition, outer mounting surfaces 30*e* may be arranged along an outer perimeter of the substrate 3, in particular of the mounting section 30, and may also be used for fixing the substrate 3 to the base.

For establishing an electrical contact with the LEDs carried on the substrate 3, the substrate may be provided with contact surfaces 33 which may be arranged similarly to the mounting surfaces 30*b*, 30*e*. The contact surfaces 33 may be located along the outer perimeter of the substrate 3. In the exemplary embodiment shown in FIG. 1, two contact surfaces 33 assigned to the second contact element 5 maybe arranged in the mounting section 30. Further contact surfaces 34 may be provided in order to establish an electrical contact with the first contact element 4 (see FIG. 11).

The first contact element 4 may comprise an electrical contact 40, a conductor portion 41 and a fitting portion 42. The electrical contact 40 maybe formed as a contact pile and/or contact point protruding from the contact element 4 in the insertion direction I. The electrical contact 40 maybe formed at an end region of a leg 41*a* of the conductor portion 41. The leg 41*a* may extend downwardly in the insertion direction I from a beam 41*b* extending essentially perpendicularly away from the fitting portion 42, i.e. essentially perpendicularly to the insertion direction I. The fitting portion 42 of the first contact element 4 may have outer fitting surfaces 43 which can be shaped complementarily to the inner circumference of the holding portion 21, in particular to the cavity 26 thereof. Inner fitting surfaces 44 of the contact element 4 may be shaped and arranged in such a way that they lie flush against the further contact surfaces 34 in the fully assembled state W.

The second contact element 5 may be provided with a second electrical contact 50, a second conductor portion 51 which may be part of or integrated into a second fitting portion 52 having an outer fitting surface 53 and at least one inner fitting surface 54. The second electrical contact 50 maybe formed e.g. as a thread complying with the B26 standard. The second conductor portion 51 extending upwardly from the second electrical contact 50 against the insertion direction I may be omitted when the second electrical contact 50 merges with the fitting portion 52 as shown herein. The outer fitting surface 53 may be shaped complementarily to the inner circumference of the cavity 26. The second inner fitting surface 54 may be shaped complementarily to the outer perimeter of the substrate 3 in the region of the contact surfaces 33. The second inner fitting surfaces 54 may be shaped and arranged in such a way that they lie flush against outer perimeter of the substrate 3 in the region of the contact surfaces 33 in the fully assembled state W.

The dome 6 may have a tubular body 60 with a lower rim portion 61 circumferentially encompassing an opening 62 of the tubular body 60 which opens in the insertion direction I in order to be able to insert the substrate 3 into the dome 6. Counter latching means 63 may be arranged in the region of the lower edge portion 61 and configured to interact with the latching elements 22*b* formed at the base 2 in order to fix the dome 6 to the base 2 in the fully assembled state W.

FIGS. 2 to 5 show the assembly 1 in the fully assembled state W in a schematic front view, schematic side view, schematic bottom view, and schematic top view, respectively. In order to arrive at the fully assembled state W, several pre-assembled states V maybe defined between the unassembled state U and the fully assembled state W. In any case, in the fully assembled state W, the base 2, the substrate 3, the first contact element 4, the second contact element 5 and the dome 6 are joined essentially so that they constitute a stable LED light bulb.

Figure 2:
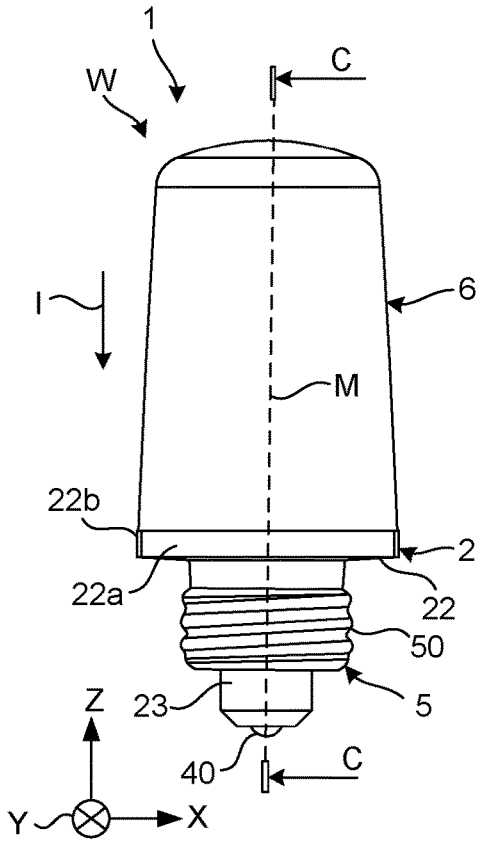
FIG. 2 is a schematic front view of the assembly shown in FIG. 1 in a fully assembled state.
Figure 3:
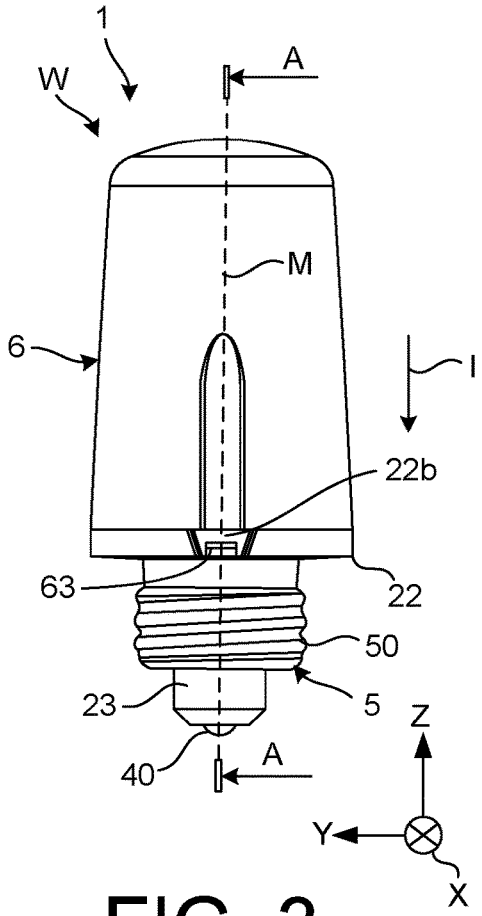
FIG. 3 is a schematic side view of the assembly shown in FIG. 2.
Figure 4:
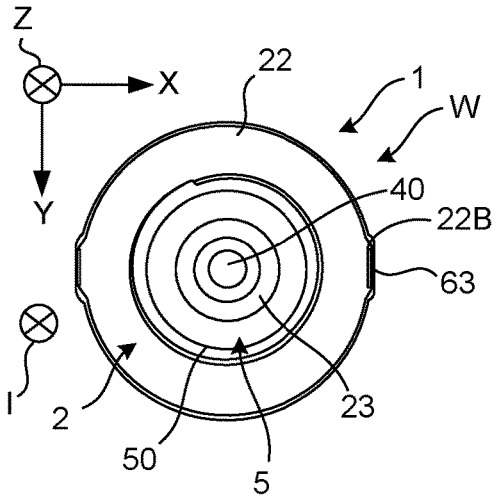
FIG. 4 is a schematic bottom view of the assembly shown in FIGS. 2 and 3.

As can be seen especially in FIGS. 2 and 3, in a lower end region of the assembly 1, the first electrical contact 40 protrudes downwardly from the stud 23. The second contact element 5 is fitted around the collar 24 and provides the second electrical contact 50. The dome 6 is fitted on the flange 22 of the base 2 with the counter latching elements 63 of the dome snapped into the latching elements 22*b* on the base so that the dome 6 is removably affixed to the base 2.

Figure 6:
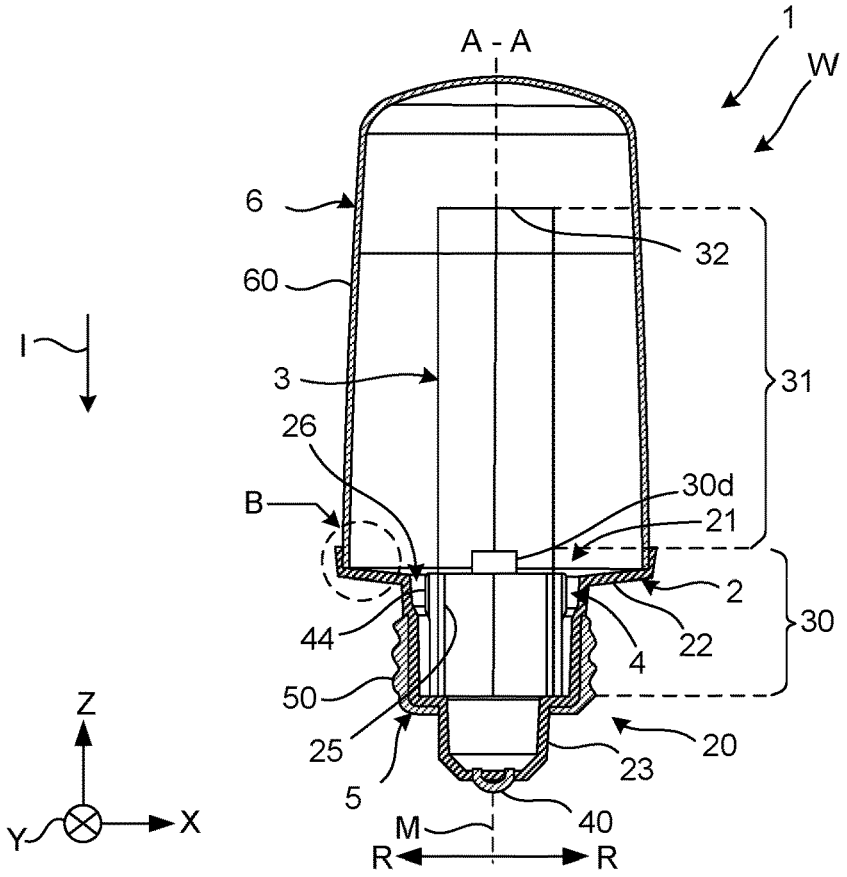
FIG. 6 is a schematic cross-sectional view along the cross-sectional line A-A illustrated in FIG. 3.

FIG. 6 shows the assembly 1 in the fully assembled state W in a schematic cross-sectional view along the cross-sectional line A-A illustrated in FIG. 3. Here it becomes apparent, that in the fully assembled state W, the mounting portion 30 of the substrate 3 is inserted into the cavity 26 so that the holder 25 engages the mounting portion 30. The holding surfaces 25*b* are aligned and in abutment with the inner mounting surfaces 30*b* of the substrate 3. In other words, the inner mounting surfaces 30*b* of the substrate 3 lie flush against the holding surfaces 25*b* of the base 2. Thereby, the mounting section 30, in particular the inner mounting surfaces 30*b*, are superimposed with the holding portion 21, in particular the holding surfaces 25*b* of the holder 25 in a projection along the radial direction R of the assembly 1. In a similar manner, the inner fitting surfaces 44 of the first contact element 4 abut further contact surfaces 34 of the substrate 3.

Hence, the substrate 3 is jammed with its mounting section between the holder 25 and the first contact element 4 and protrudes longitudinally upwards therefrom without the need of being additionally held in the region of the cap 32 within the dome 6. These are possible ways, in which the holding portion 21 and the mounting section 30 in the fully assembled state W abut each other in at least one of several possible planes extending essentially in parallel to the central axis M. The number of such planes is not particularly limited, since their surface normal vectors may simply extend perpendicularly to the central axis M, e.g. in parallel to and/or superimposed with the respective radial direction R.

Figure 7:
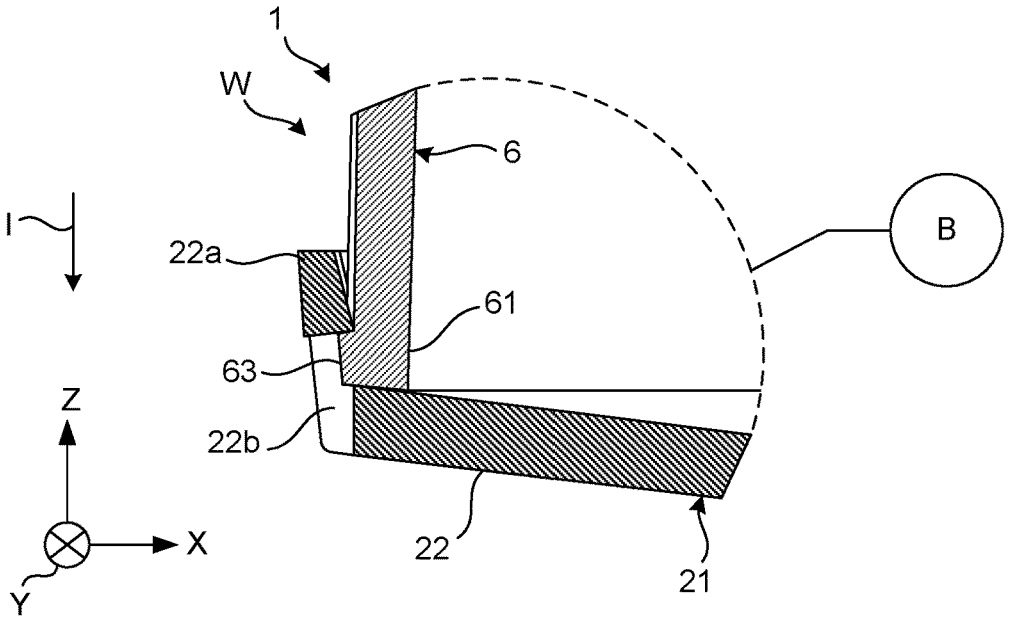
FIG. 7 is a detailed B illustrated in FIG. 6.

FIG. 7 shows a detail B illustrated in FIG. 6. Here it becomes apparent how the dome 6 is latched to the base 2 in the fully assembled state W. The counter latching means 63 in form of lugs or latching noses jut into the latching elements 22*b* which maybe formed as indents, recesses, through-holes or alike in the rim 22*a*. The lower rim portion 61 of the dome 6 may be circumferentially encompassed by the rim 22*a* and therefore may be inserted into the rim 22*a* at the flange in the insertion direction I, such that the dome 6 is firmly held at the base 2.

Figure 8:
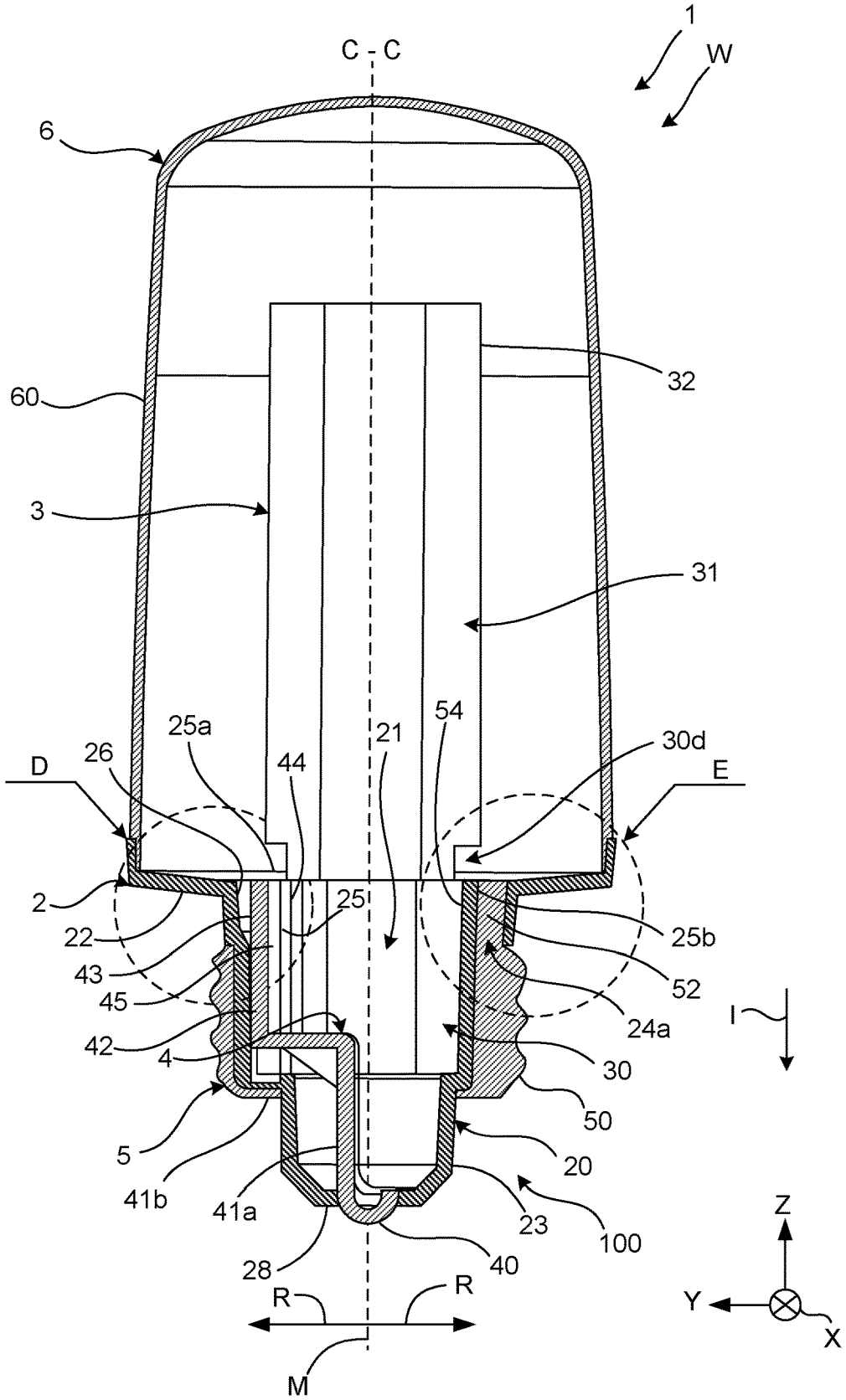
FIG. 8 is a schematic cross-sectional view along the cross-sectional line C-C illustrated in FIG. 2.

FIG. 8 shows the assembly 1 in the fully assembled state W in a schematic cross-sectional view along the cross-sectional line C-C illustrated in FIG. 2. Here it becomes apparent that in the region of the connection portion 20, the holding portion 21, the first contact element 4 and the second contact element 5 together form a connector 100 of the assembly 1. The connector 100 may protrude downwardly from the flange 22 in the insertion direction I and allows for mechanically as well as electrically connecting the assembly to a socket (not shown).

The first electrical contact 40 protrudes below the stud 23 in the insertion direction I. The leg 41*a* extends upwardly from the first electrical contact 40 and merges with the beam 41*b* connecting the leg 41*a* to the fitting portion 42 which may be arranged between the inner circumference of the cavity 26 and the mounting section 30. The electrical contact 40 allows for electrically connecting the assembly to a first electrical counter contact of the socket.

The fitting portion 42 may be jammed between the walls of the cavity 26 and the mounting section 30 in such a way that inner fitting surfaces 44 lie flush against the substrate 3, in particular contact surfaces 34 thereof, and the outer fitting surfaces 43 lie flush against the inner circumference of the cavity 26. These are possible ways, in which the holding portion 21 and the mounting section 30 in the fully assembled state W abut each other in at least one of several possible planes extending essentially in parallel to the central axis M. The number of such planes is not particularly limited, since their surface normal vectors may simply extend perpendicularly to the central axis M, e.g. in parallel to and/or superimposed with the respective radial direction R.

The second contact element 5 may be in engagement with the connection portion 20 of the base in that the second fitting portion 52 is inserted into the opening 24*a* of the collar 24. Thereby, the second inner fitting surfaces 54 may lie flush against the holding surfaces 25*b* of the holder 25 as well as the contact surfaces 33 of the substrate 3. The second electrical contact 50 may be formed as a thread allowing for a mechanical as well as an electrical connection of the assembly 1 to a second counter contact element within the socket. Additional mechanical stability on an installation comprising the assembly 1 within a socket may be provided by the lower surface of the flange 22 facing essentially into the insertion direction I and allowing for an abutment of the assembly to an upper rim of the socket. Further mechanical stability may be provided by the stud 23 which may jut into a complementarily formed opening formed within the socket.

Figure 9:
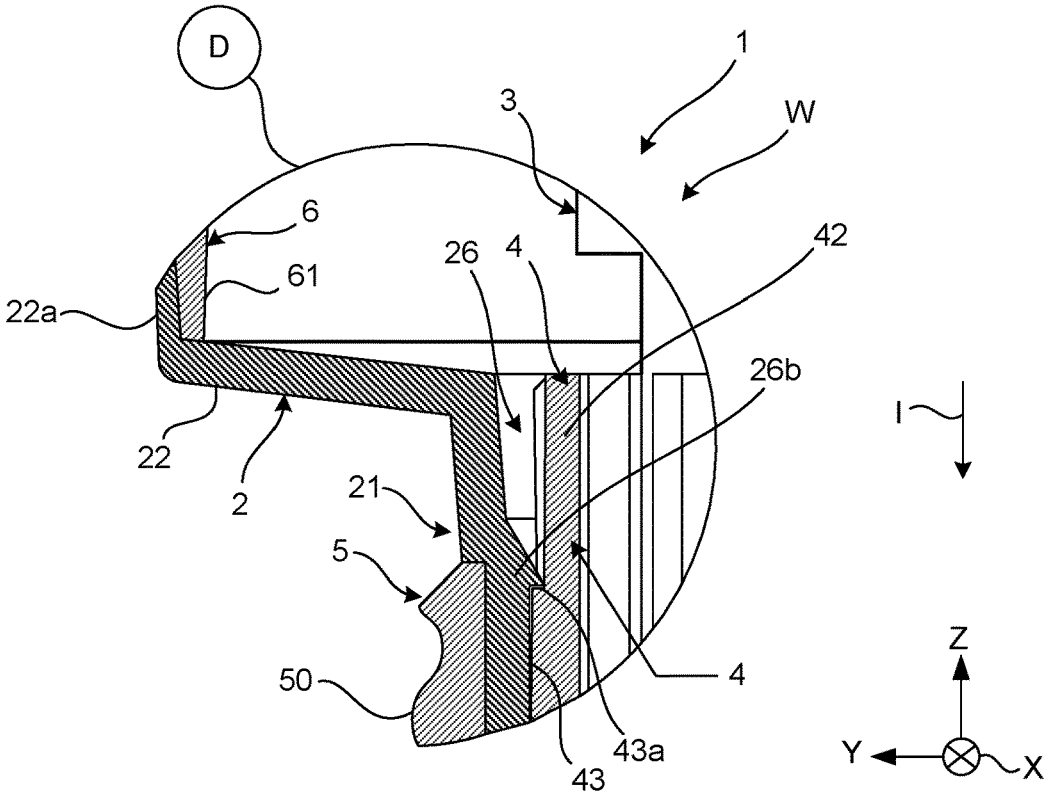
FIG. 9 is a detail D illustrated in FIG. 8.

FIG. 9 is a detail D illustrated in FIG. 8. Here it becomes apparent that the shoulder 43*a* is formed at the outer fitting surface 43 of the fitting portion 42 and that a ledge 26*b* is formed within the cavity 26. Thereby, the first contact element 4 is latched to the holding portion 21 so that movements of the first contact element 4 with respect to the base 2 against the insertion direction I are inhibited.

Figure 10:
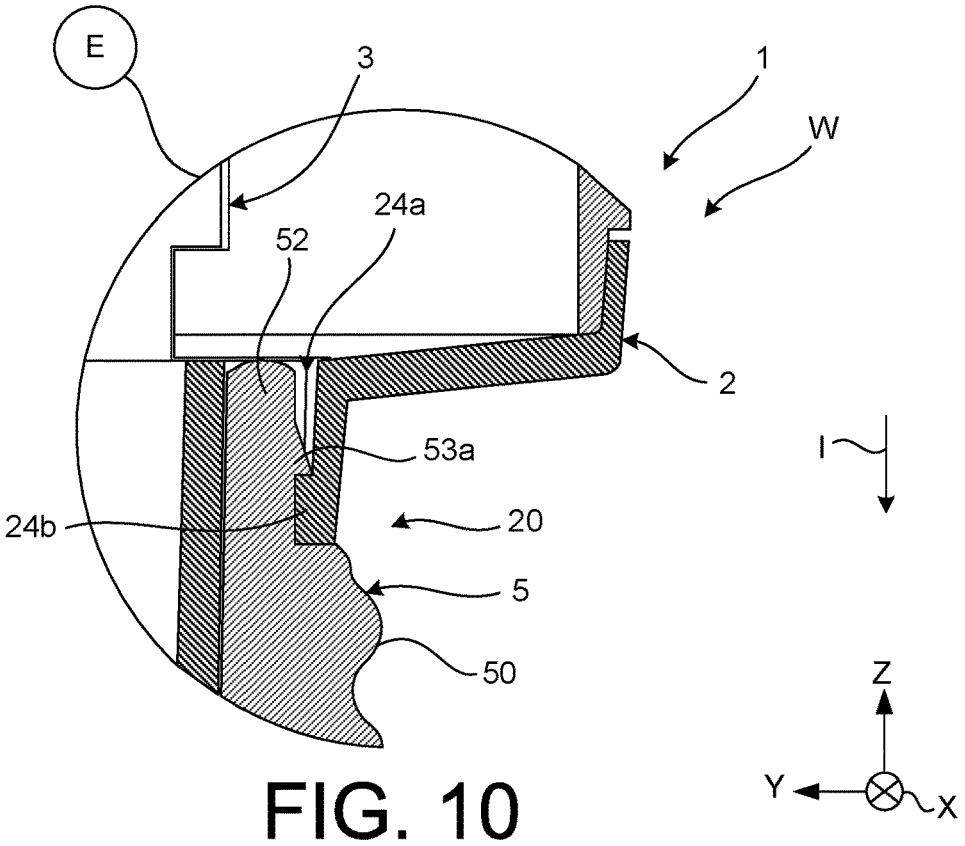
FIG. 10 is a detail E illustrated in FIG. 8.

FIG. 10 shows a detail E illustrated in FIG. 8. Here it becomes apparent that within the opening 24*a* of the collar 24, a bulge 24*b* is formed which projects away from a wall portion of the opening 24*a* against the radial direction R and is an engagement with the second fitting portion 52 of the second contact element 5. The second fitting portion 52 is provided with an indentation at an upper end region in that a nose 53*a* is formed at the outside of the second fitting portion 52. The nose 53*a* overlaps with the bulge 24*b* and thereby inhibits movements of the second contact element 5 with respect to the base 2 in the insertion direction I. In other words, in the fully assembled state W, the second contact element 5 is latched to the base 2 with the help of the bulge 24*b* and the nose 53 which provide that the contact element 5 superimposes the base 2 in projection along insertion direction I, thereby establishing a positive fit between the second contact element 5 and the base 2.

Figure 5:
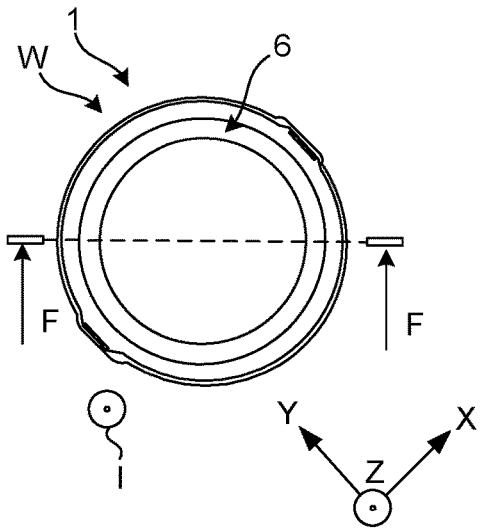
FIG. 5 is a schematic top view of the assembly shown in FIGS. 2 to 4.
Figure 11:
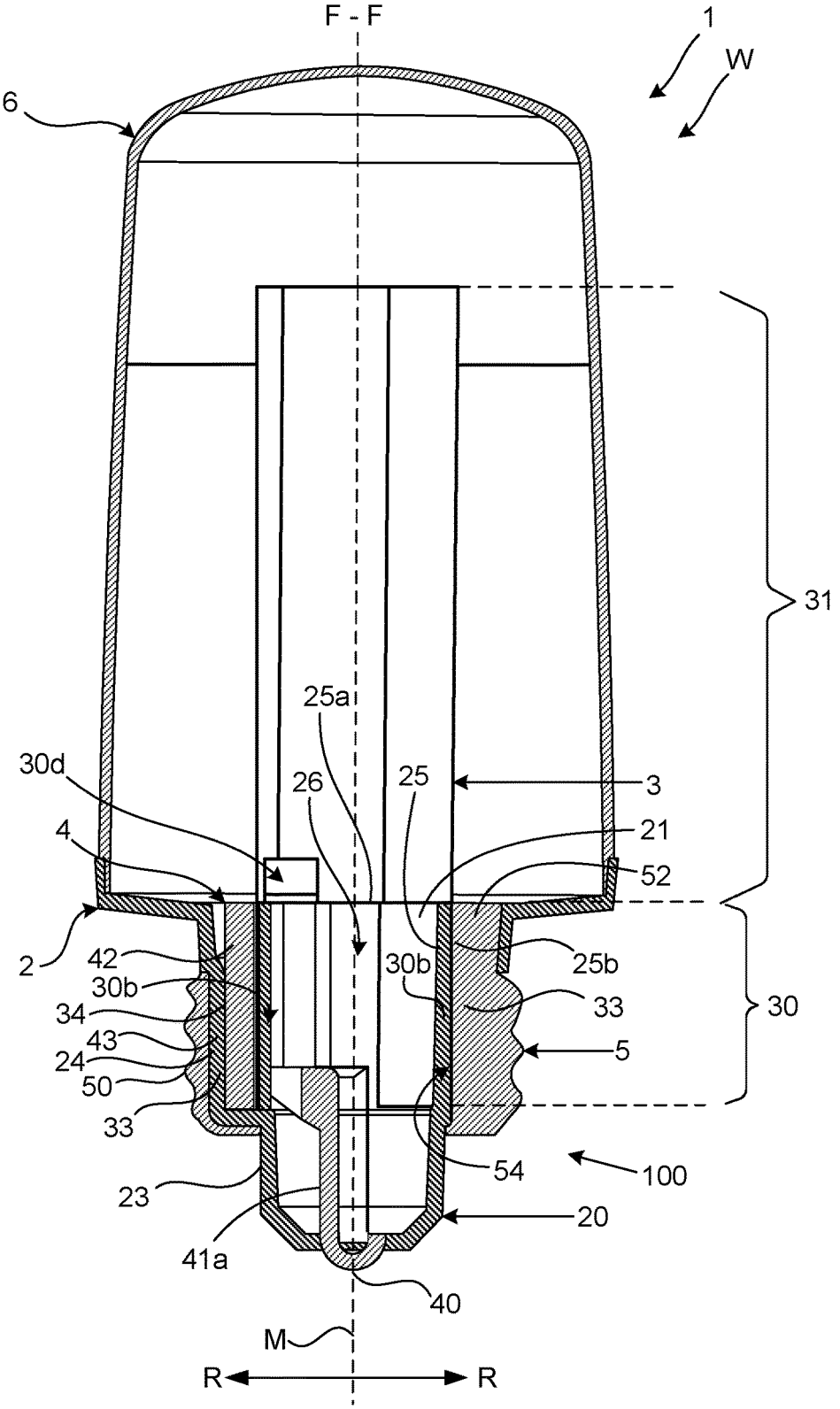
FIG. 11 is a schematic cross-sectional view along the cross-sectional line F-F illustrated in FIG. 5.

FIG. 11 shows a schematic cross-sectional view of the assembly 1 in the fully assembled state W along a cross-sectional line F-F illustrated in FIG. 5. Here it becomes apparent that on the side of the first contact element 4, in particular the fitting portion 42 thereof, the mounting section 30 of the substrate 3 may be sandwiched between the holder 25 and the first contact element 4. The inner mounting surfaces 30*g* of the substrate 3 may lie flush against the holding surfaces 25*b* of the holder. The outer contact surfaces 34 may lie flush against the inner fitting surfaces 44 of the contact element 4. These are possible ways, in which the holding portion 21 and the mounting section 30 in the fully assembled state W abut each other in at least one of several possible planes extending essentially in parallel to the central axis M. The number of such planes is not particularly limited, since their surface normal vectors may simply extend perpendicularly to the central axis M, e.g. in parallel to and/or superimposed with the respective radial direction R.

The contact element 4, in particular the fitting portion 42 thereof may be sandwiched between the mounting section 30 and the wall of the cavity 26. While the inner fitting surfaces 44 of the contact element 4 may lie flush against the mounting section 30, the outer fitting surfaces 43 of the fitting portion 42 may lie flush against the inner wall of the cavity 26. The fitting portion 42 of the first contact element 4 may be electrically isolated from the second contact element 5 surrounding the holding portion 21 by the collar 24 of the connection portion 20.

On the side of the connection portion 20 opposing the fitting portion 42 of the first contact element 4 with respect to the central axis M, the substrate 3, in particular the mounting section 30 thereof, may be sandwiched between the second fitting portion 52 of the second contact element 5 and the holder 25. The inner mounting surfaces 30*b* of the substrate 3 may lie flush against the holding surfaces 25*b* of the holder 25 while the inner fitting surfaces 54 of the second contact element 5, in particular the fitting portion 52 thereof, may lie flush against the contact surfaces 33, 34 and/or mounting surfaces 33*b*, 33*e* of the substrate 3.

Due to the base 2, the substrate 3, the first contact element 4 and the second contact element 5 all overlapping each other in the radial direction R in the region of the connection section 30, the substrate 3 is firmly held within the holding portion 21 and the connector 100 has a high stability. The substrate 3 may be regarded as being wedged within the holding portion 21 and thereby held with a friction fit and/or force fit at the base 2. The connection portion 20 and the holding portion 21 may overlap, i.e. they may be superimposed in the radial direction R.

Figure 12:
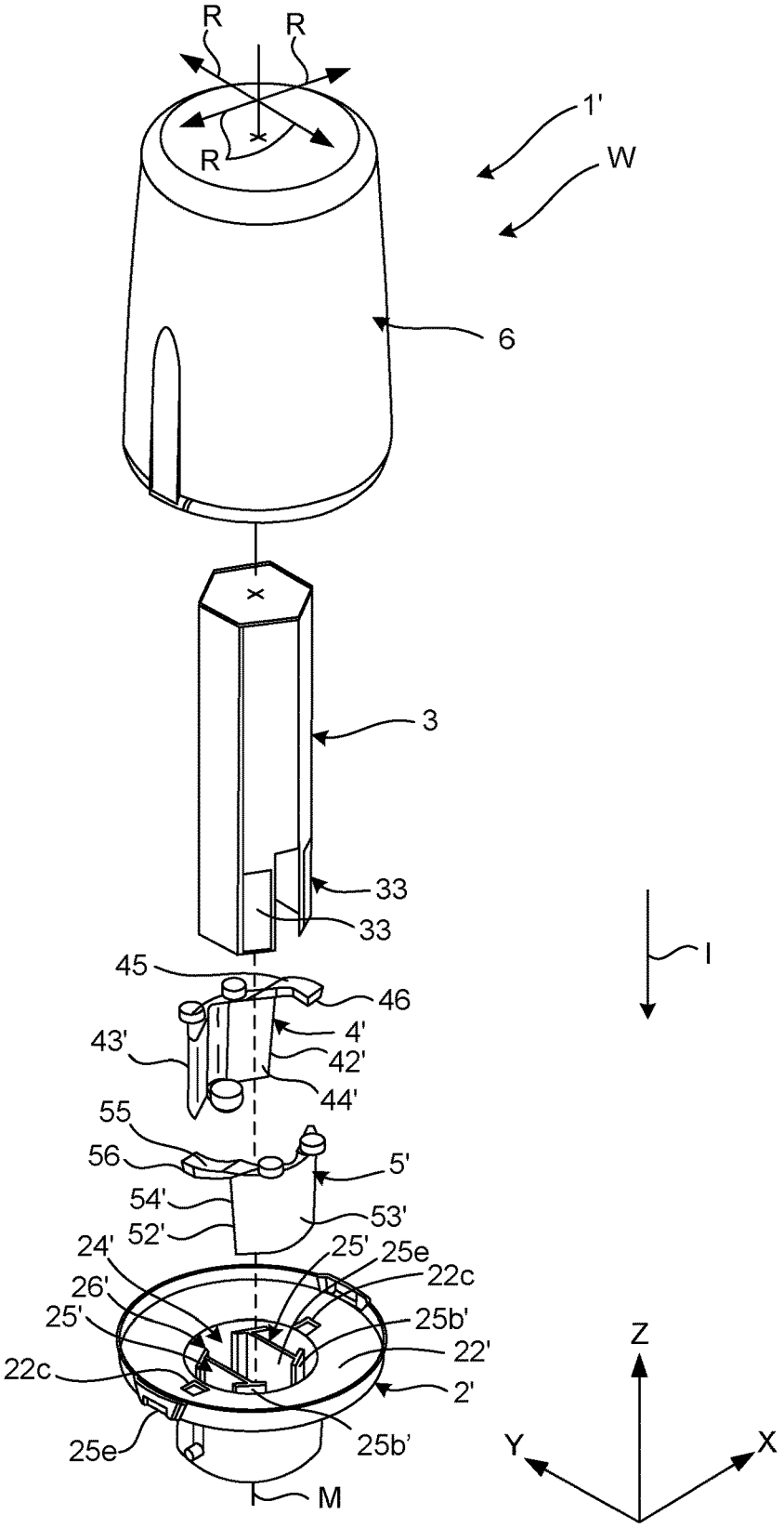
FIG. 12 is a schematic exploded view of another embodiment of a LED light bulb assembly according to the present invention.

FIG. 12 shows a schematic perspective exploded view of a LED light bulb assembly 1' according to another embodiment of the present invention. For the sake of brevity, only the differences between the assembly 1' and the assembly 1 will be explained in detail in the following. The assembly 1' may comprise a substrate 3 and a dome 6 which may have the same design as the substrate 3 and the dome 6 used in the assembly 1. However, the assembly 1' may comprise a base 2', a first contact element 4' and a second contact element 5' which allow for connecting the assembly 1' to different kinds of sockets (not shown) as the assembly 1. In particular, the assembly 1' may be designed such that it may be compatible to so-called by bayonette-type sockets like e.g. the standardised B22 socket.

FIGS. 13 to 16 show the assembly 1' in the fully assembled state W in a schematic front view, a schematic side view, a schematic bottom view and a schematic top view, respectively. In contrast to the assembly 1, the assembly 1' may have a connector 100' suitable for bayonette type sockets and/or couplings. The connector 100' may therefore be provided with two pins 27 laterally protruding in the radial direction R from a connection portion 20' of the base 2' on opposing sides thereof. Further, two electrical contacts 40', 50' which may be formed at the contact elements 4' and 5', respectively, may protrude downwardly from the connection portion 20' in the insertion direction so that they jut below a bottom 28' of the connection portion 20'.

For fitting the contact elements 4' and 5' to the base 2', the contact elements 4' and 5' may be provided with an extension 45 and an extension 55, respectively. Distal end regions of the extensions 45 and 55 may be each provided with a boss 46 and 56, respectively. The bosses 46 and 56 may be shaped complementarily to recesses 25*e* formed in a flange 22' of the base 2'. In the fully assembled state W, the bosses 46 and 56 of the contact element 4' and the contact element 5', respectively, may jut into the recesses 22*c* formed at the base 2'.

Further, a holding portion 21' of the base 2' may comprise a cavity 26' similar to as it is formed in the base 2 of the assembly 1. However, in difference to the holding portion 21 of the base 2, the holding portion 21' of the base 2' may comprise two holders 25' which may have two holding surfaces 25*b*'. The holding surfaces 25' may be connected to each other by a wall 25*e* which helps stabilising the holder 25'.

Figure 17:
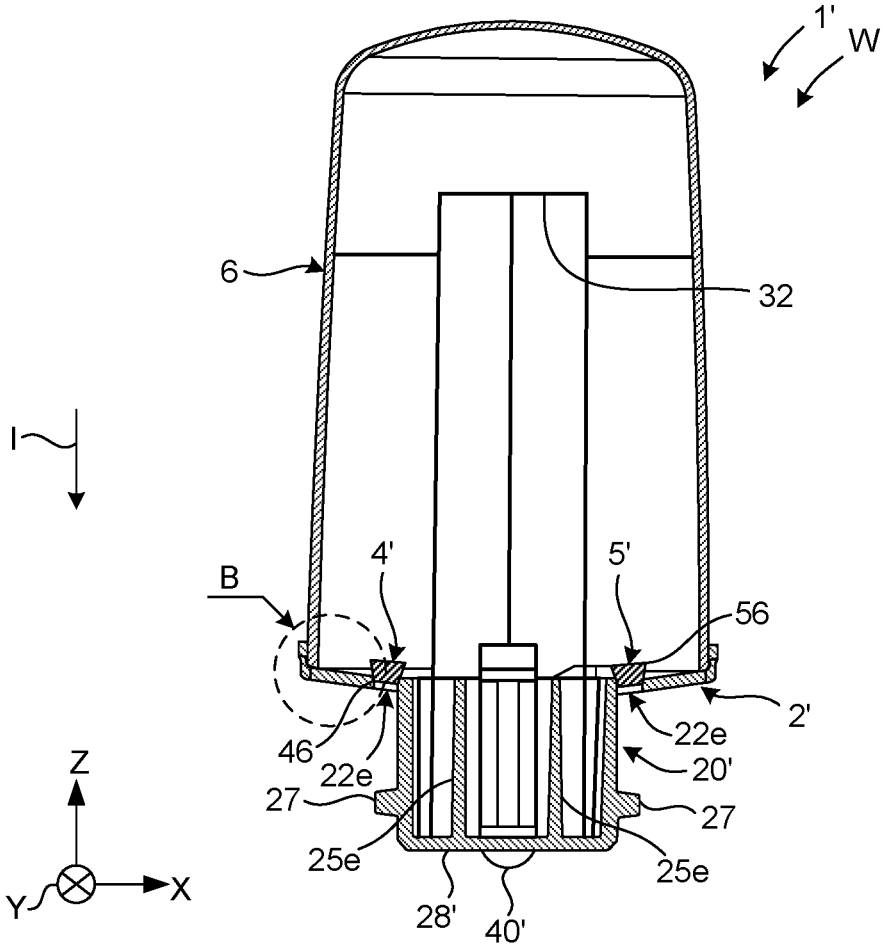
FIG. 17 is a schematic cross-section view of the assembly shown in FIGS. 13 to 16 along the cross-sectional line A-A illustrated in FIG. 14.
Figure 18:
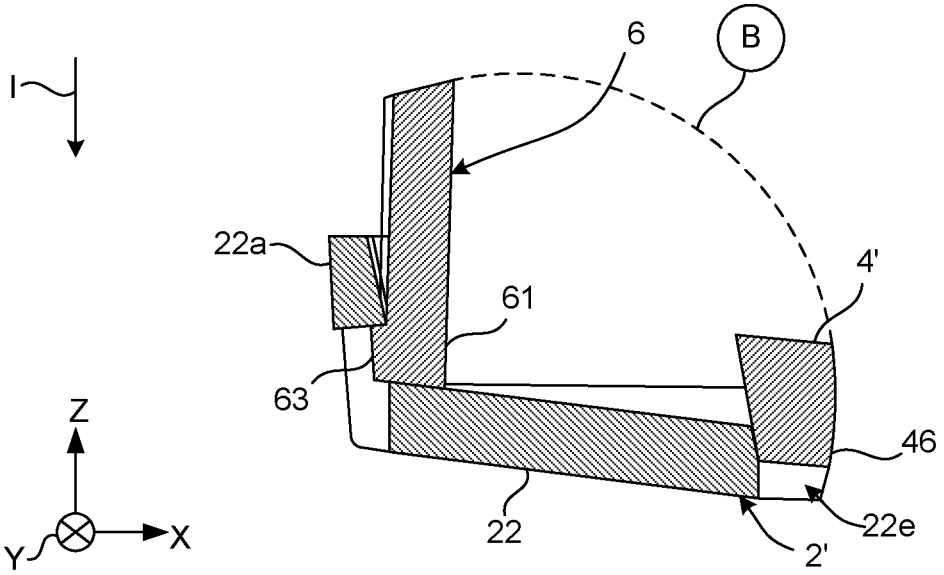
FIG. 18 is a detail illustrated in FIG. 17 of the assembly shown in FIGS. 13 to 17.

FIG. 18 shows a detail B illustrated in FIG. 17. Here it becomes apparent, that the bosses 46, 56 are tapering in the insertion direction I, so that they may be wedged within the recesses 22 in order to provide for a force fit and/or friction fit of the contact elements 4', 5' at the base 2'. Further it becomes apparent, that similar to the assembly 1, the dome 6 of the assembly 1' is latched to the base 2' with the help of latching means 22*a* and counter latching means 63 in a manner described above with respect to the assembly 1 shown in FIGS. 1 to 11.

Figure 13:
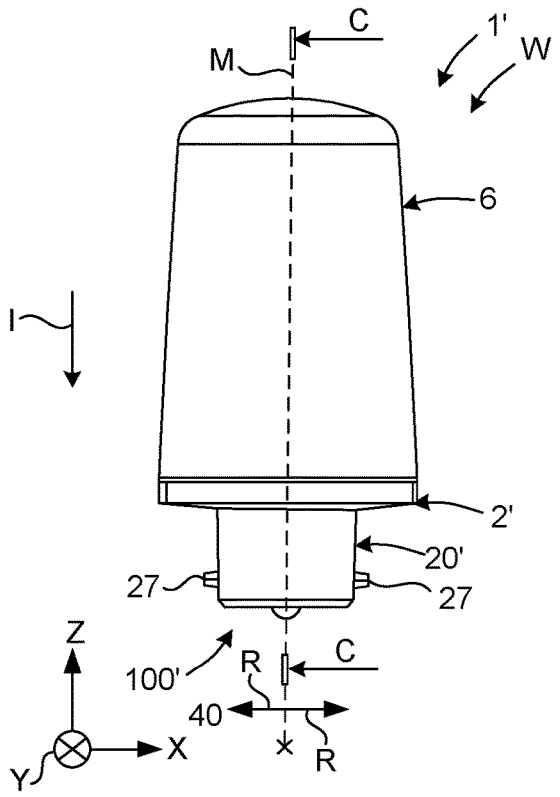
FIG. 13 is a schematic front view of the assembly shown in FIG. 12 in a fully assembled state.
Figure 14:
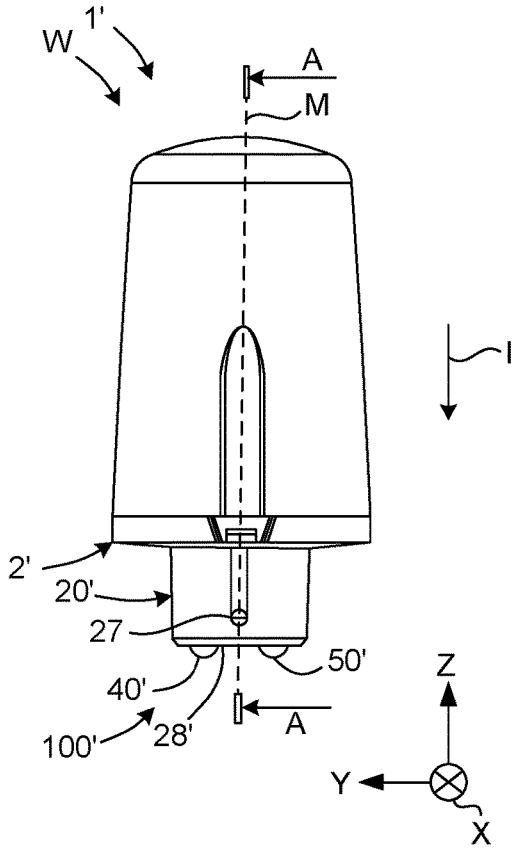
FIG. 14 is a schematic side view of the assembly shown in FIG. 13.
Figure 15:
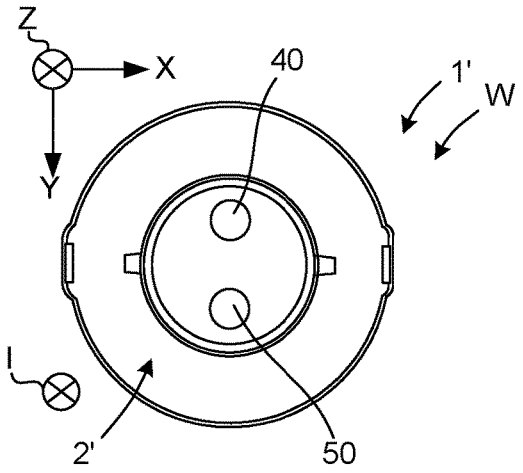
FIG. 15 is a schematic bottom view of the assembly shown in FIGS. 13 and 14.
Figure 19:
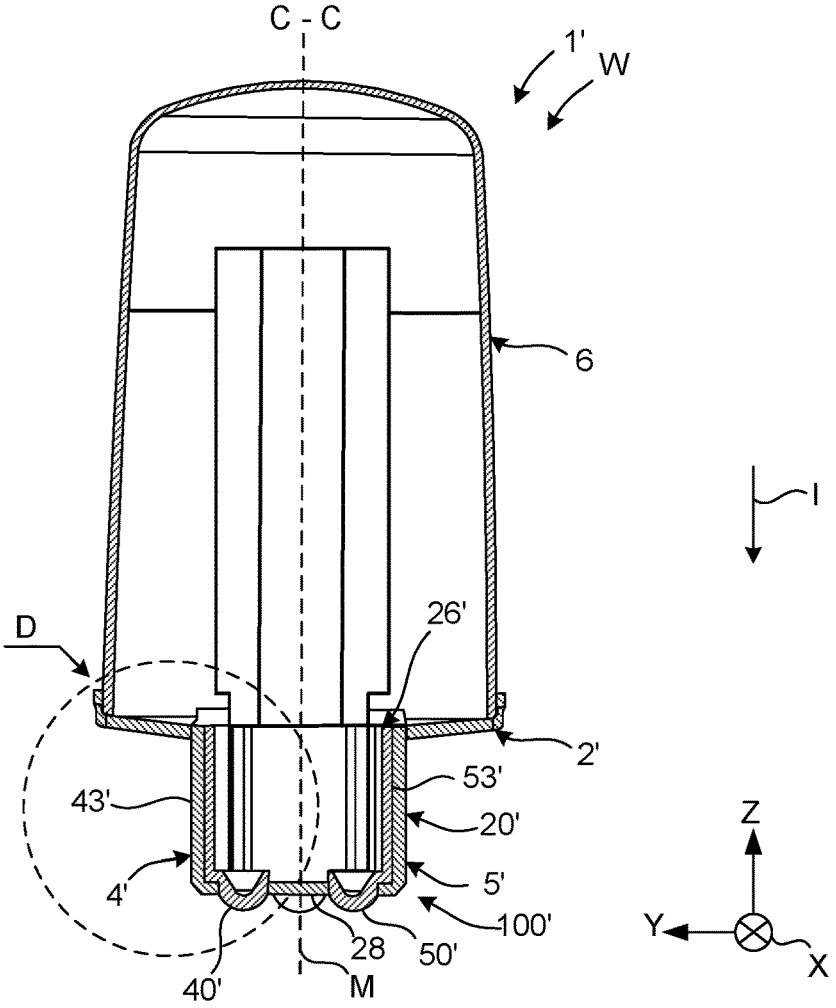
FIG. 19 is a schematic cross-sectional view of the assembly shown in FIGS. 13 to 19 along the cross-sectional line C-C illustrated in FIG. 13.

FIG. 19 shows the assembly 1' in the fully assembled state W in a schematic cross-sectional view along the cross-sectional line C-C illustrated in FIG. 13. The contact elements 40' and 50' may be inserted into the cavity 26 such that outer fitting surfaces 43' and 53', respectively, lie flush against the inner circumference of the cavity 26. The contact 40' and 50' may jut through respective through-holes formed within the bottom 28' of the connection portion 20'.

Figure 20:
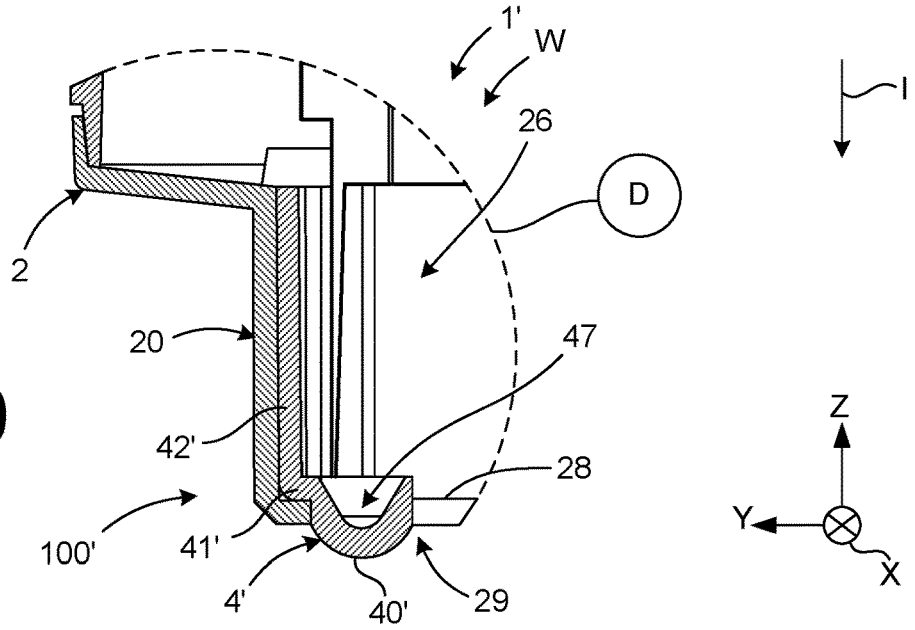
FIG. 20 is a detail D illustrated in FIG. 19 of the assembly shown in FIGS. 13 to 19.

FIG. 20 shows a detail D illustrated in FIG. 19. Here it becomes apparent, how the electrical contact 40' extends from the interior of the assembly 1', in particular of the connection portion 20', through a hole 29 in the bottom 28' to the outside of the assembly 1'. A conductor portion 41' connects the electrical contact 40' to the fitting portion 42' of the contact element 4'. The electrical contact 40' may be provided with a contact cavity 47 on its side facing against the insertion direction I.

Figure 16:
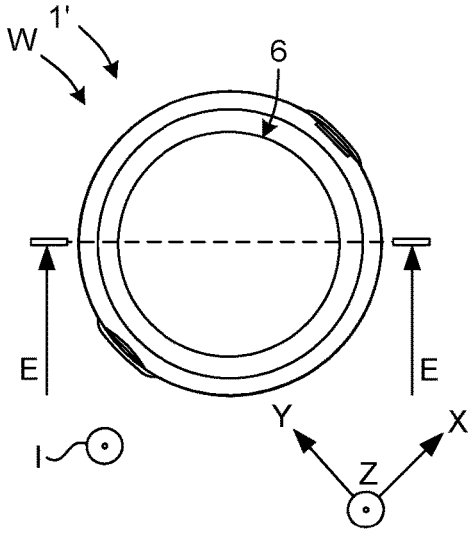
FIG. 16 is a schematic top view of the assembly shown in FIGS. 13 to 15.
Figure 21:
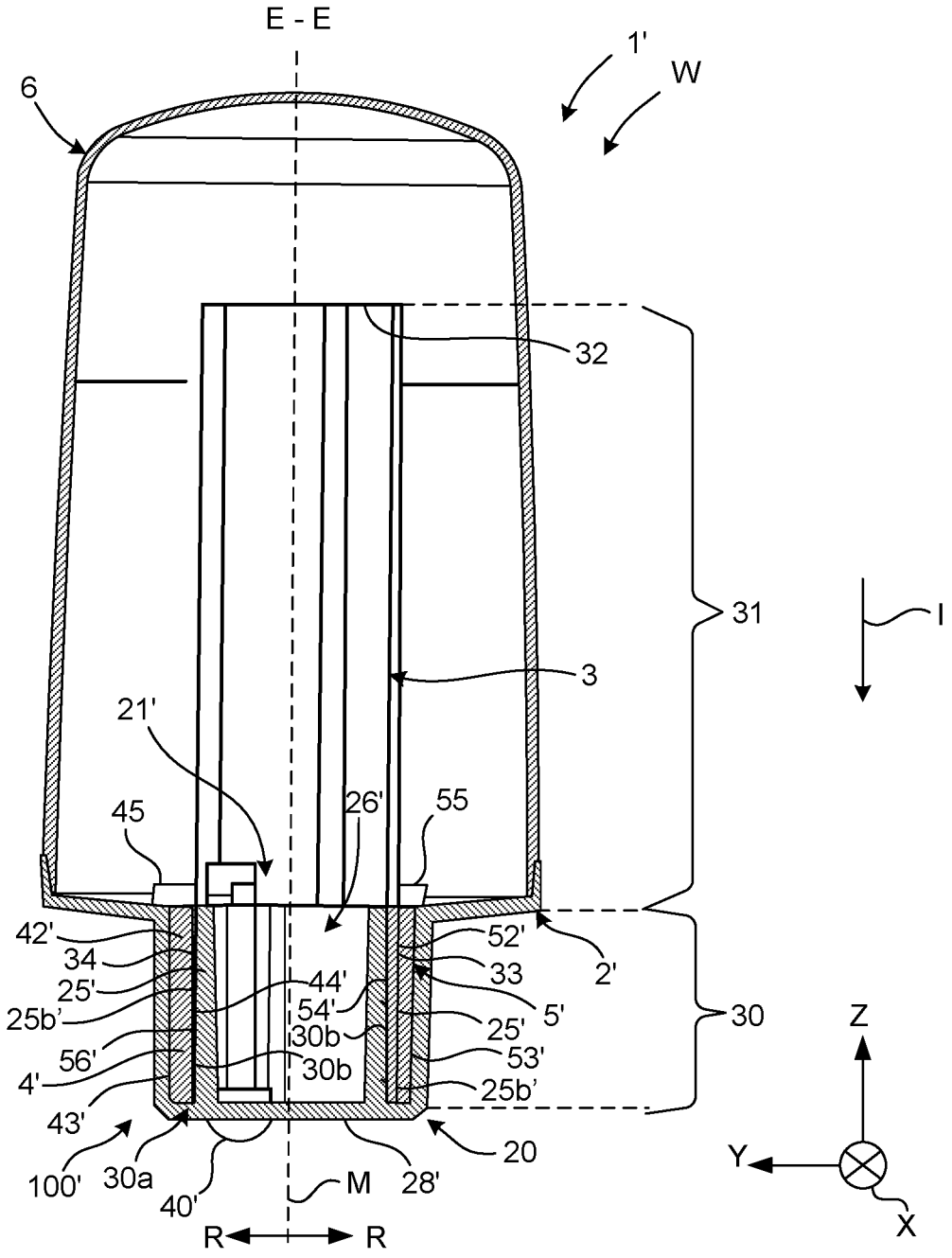
FIG. 21 is a schematic cross-sectional view of the assembly shown in FIGS. 13 to 20 along the cross-sectional line E-E illustrated in FIG. 16.

FIG. 21 shows the assembly 1' the fully assembled state W in a schematic cross-sectional view along the cross-sectional line E-E illustrated in FIG. 16. Here it becomes apparent that the mounting section 30 the of substrate 3 on one side may be sandwiched between one of the holders 25' and the contact element 4' and on another side between one of the holders 25' and the second contact element 5'. The inner mounting surface 30*b* may lie flush against the holding surface 25*b* while the further contact surface 34 may lie flush against the inner fitting surface 44' of the first contact element 4'. The fitting portion 42' of the first contact element 4' may be sandwiched between the substrate 3 and the wall of the cavity 26'. The outer fitting surface 43' may lie flush against the inner circumference of the cavity 26'. These are possible ways, in which the holding portion 21' and the mounting section 30 in the fully assembled state W abut each other in at least one of several possible planes extending essentially in parallel to the central axis M. The number of such planes is not particularly limited, since their surface normal vectors may simply extend perpendicularly to the central axis M, e.g. in parallel to and/or superimposed with the respective radial direction R.

On the other side, the mounting section 30 may be sandwiched between the holder 25' and the contact element 5'. The inner mounting surface 33 may lie flush against the holding surface 25'. These are possible ways, in which the holding portion 21' and the mounting section 30 in the fully assembled state W abut each other in at least one of several possible planes extending essentially in parallel to the central axis M. The number of such planes is not particularly limited, since their surface normal vectors may simply extend perpendicularly to the central axis M, e.g. in parallel to and/or superimposed with the respective radial direction R.

The contact surface 33 may lie flush against the outer fitting surface 54' of the contact element 5'. The fitting portion 52' of the second contact element 5' may be sandwiched between the mounting section 30 and the inner circumference of the cavity 26'. The outer fitting surface 53' may lie flush against the inner circumference of the cavity 26'. The lower edge 30*a* of the mounting section 30 may be supported at the bottom 28' of the cavity 26'. Hence, the substrate 3 may be immobilised in all directions in that it is firmly held at the mounting section 30 in the holding portion 21'.

Therefore, similarly to what has been laid down above in connection with the assembly 1, the substrate 3 of the assembly 1' may extend longitudinally upwards from the holder 25' along the central axis M within the dome 6 without being connected thereto. The connection section 30 and the holding portion 21' may overlap, i.e. they may be superimposed in the radial direction R. In the region of the cap 32, no further fixation structure is needed at the dome 6 for securely mounting the substrate 3.

Deviations from the embodiments of an assembly 1, 1' according to the present invention described above are possible without departing from the inventive idea. The assembly 1, 1' may be provided with bases 2, 2', substrates 3, contact elements 4, 4', 5, 5' and translucent domes 6 in whatever number and form desired in order to provide a LED light bulb with a connector 100, 100' fulfilling requirements of respective sockets that may be designed according to certain standards.

The base 2,2' may have connection portions 20, 20', holding portions 21, 21', flanges 22, 22' with rims 22*a*, latching elements 22*b* and recesses 22*c*, as well as with studs 33, collars 24, openings 24*a*, bulges 24*b*, holders 25, 25', holding surfaces 25*b*, 25*b'*, corners 25*c*, cut-outs 25*d*, walls 25*b*, cavities 26, 26' with edges 26*a* and ledges 26*b*, as well as with pins 27, bottoms 28, 28' and/or through-holes 29 in whatever number and form desired in order to hold substrates 3 in a form fit, friction fit and/or positive fit manner.

The substrate 3 may be provided with mounting sections 30 having lower edges 30*a*, inner mounting surfaces 30*b*, corners 33, slots or notches 30*d* and outer mounting surfaces 30, as well as illuminating sections 31, caps 32 and/or contact surfaces 33, 34 in whatever number and form desired in order to carry and electrically connect one or more LEDs of the assembly 1, 1'.

The first contact element 4, 4' and/or the second contact element 5, 5' may be provided with first second electrical contacts 40, 40', 50, 50', conductor portions 41, 41', 51, 51', fitting portions 42, 42', 52, 52', outer fitting surfaces 43, 43', 53, 53', inner fitting surfaces 44, 44', 54, 54', extensions 45, 55, bosses 46, 56, noses 53*a* and/or contact cavities 47 in whatever number and form desired for holding and/or electrically contacting the substrate 3 and/or counter contacts within a socket.

The translucent dome 6 may have a tubular body 60 being provided with lower rim portions 61, openings 62 and/or counter latching means 63 in whatever number and form desired in order to cover the substrate 3 and/or protect an interior of the assembly 1, 1'.

The invention claimed is:

1. An LED light bulb assembly comprising:

a base having a connection portion, said base having a holding portion formed in an interior thereof, said connection portion and said holding portion facing in opposite directions running generally parallel to a central axis of the LED light bulb assembly;

a substrate carrying at least one LED, said substrate having a mounting section which is inserted into said holding portion, wherein said holding portion and said mounting section abut each other in a plane extending parallel to the central axis, said mounting section having at least one contact surface formed therein, said substrate having a slot formed through a wall of said substrate and open at a lower end of said substrate;

a first contact element received in or on said mounting section and in electrical connection with the at least one contact surface of said mounting section, said first contact element inserted into said holding portion of said base and in electrical connection with said connection portion of said base, said first contact element having an electrical contact and a conductor portion and a fitting portion, said conductor portion being received by the slot of said substrate, said fitting portion slidably received in an interior of said substrate, said electrical contact being in electrical connection with said base; and a second contact element affixed to said base, said second contact element being externally threaded and adapted to be connected to an electrical lightbulb base, said second contact element having a portion received in a slot of said base, the portion of said second contact element being in electrical connection with said connection portion.

2. The LED light bulb assembly of claim 1, wherein said substrate at least partially protrudes into said holding portion.

3. The LED light bulb assembly of claim 1, wherein said substrate and said connection portion superimpose each other in a radial direction, the radial direction extending perpendicularly away from the central axis.

4. The LED light bulb assembly of claim 1, wherein said holding portion is at least partially arranged in a cavity formed within an extension of said base, an outer perimeter of the extension forming at least a portion of said connection portion.

5. The LED light bulb assembly of claim 1, wherein said mounting section is in a positive engagement with said holding portion.

6. The LED light bulb assembly of claim 1, wherein a portion of a cross-section of said mounting section has a polygonal shape in a projection along the central axis.

7. The LED light bulb assembly of claim 1, wherein said at least one contact surface has a plurality of contact surfaces, wherein the plurality of contact surfaces and the plurality of mounting surfaces are arranged in an alternating manner along an outer perimeter or an inner perimeter of said substrate.

8. The LED light bulb assembly of claim 1, wherein said at least one first contact element has a fitting portion which is shaped to fit into a slot of said mounting section.

9. The LED light bulb assembly of claim 1, further comprising:

at least one translucent dome attached to said base and housing said substrate.

10. A method of assembling an LED light bulb assembly comprising:

providing a base with a connection portion and with a holding portion formed interior of said base, the connection portion and the holding portion facing in opposite directions parallel to the central axis of the LED light bulb assembly;

providing a substrate with a mounting section, the substrate carrying at least one LED, the mounting section having a slot formed through a wall thereof, through slot opening at a bottom of the mounting section;

inserting a first contact element into the holding portion such that the first contact element is in electrical connection with the connection portion of the base, the first control element having a electrical contact and a conductor portion and a fitting portion, the electrical contact being in electrical connection with the base;

inserting the mounting section of the substrate onto the first contact element and into the holding portion, the mounting section being in electrical connection with the first contact element, the conductor portion being received in the slot of the mounting section, said fitting portion being in electrical contact with the substrate;

bringing the holding portion and the mounting section into abutment with each other in a plane parallel to the central access when affixing the substrate to the holding portion;

affixing a second contact element to the base such that the second contact element has a portion received in a slot of the base, the portion of the second contact element being in electrical connection with the connection portion of the base, the second contact element having external threads thereon so as to allow the second contact element to be connected to an electric lightbulb base.

* * * * *